US006715465B2

(12) United States Patent
Hallam

(10) Patent No.: US 6,715,465 B2
(45) Date of Patent: Apr. 6, 2004

(54) INTERNAL COMBUSTION ENGINE WITH VALVE CONTROL

(75) Inventor: Paul W. Hallam, Modewarre (AU)

(73) Assignee: Ecoforce PTY Ltd., Modewarre (AU)

( * ) Notice: Subject to any disclaimer, the term of this patent is extended or adjusted under 35 U.S.C. 154(b) by 0 days.

(21) Appl. No.: 10/168,987

(22) PCT Filed: Dec. 29, 2000

(86) PCT No.: PCT/AU00/01605

§ 371 (c)(1),
(2), (4) Date: Sep. 25, 2002

(87) PCT Pub. No.: WO01/49980

PCT Pub. Date: Jul. 12, 2001

(65) Prior Publication Data

US 2003/0075143 A1 Apr. 24, 2003

(30) Foreign Application Priority Data

Dec. 30, 1999 (AU) ..... PQ 4910

(51) Int. Cl.[7] ..... F02B 75/02
(52) U.S. Cl. ..... 123/317; 123/90.14
(58) Field of Search ..... 123/90.14, 317

(56) References Cited

U.S. PATENT DOCUMENTS 2,342,003 A * 2/1944 Meyer ..... 123/90.14
4,592,313 A 6/1986 Speckhart
5,233,950 A * 8/1993 Umemoto et al. ..... 123/90.14
5,383,647 A 1/1995 Jorach et al.
5,579,735 A * 12/1996 Todero et al. ..... 123/317
5,664,527 A 9/1997 Boudy

FOREIGN PATENT DOCUMENTS

| | | |
|---|---|---|
| DE | 38 08 542 A1 | 10/1988 |
| EP | 0 631 040 B1 | 12/1994 |
| GB | 2 069 041 | 8/1981 |
| GB | 2 102 065 | 1/1983 |
| GB | 2 326 444 | 12/1998 |

* cited by examiner

*Primary Examiner*—Noah P. Kamen
(74) *Attorney, Agent, or Firm*—Stites & Harbison PLLC; Douglas E. Jackson

(57) ABSTRACT

An internal combustion engine includes at least one rotating, oscillating or reciprocating piston (20, 21) in a cylinder (11, 12). Each piston (20, 21) defines with the cylinder (11, 12) a combustion chamber (35). Each combustion chamber (35) has at least one inlet valve (36) and one exhaust valve (37), and a mechanism (40) to periodically open the inlet and exhaust valves. The valves are closed by a gas spring (80, 82) having a closing force proportional to the speed of the engine.

11 Claims, 16 Drawing Sheets

FIG. 3.
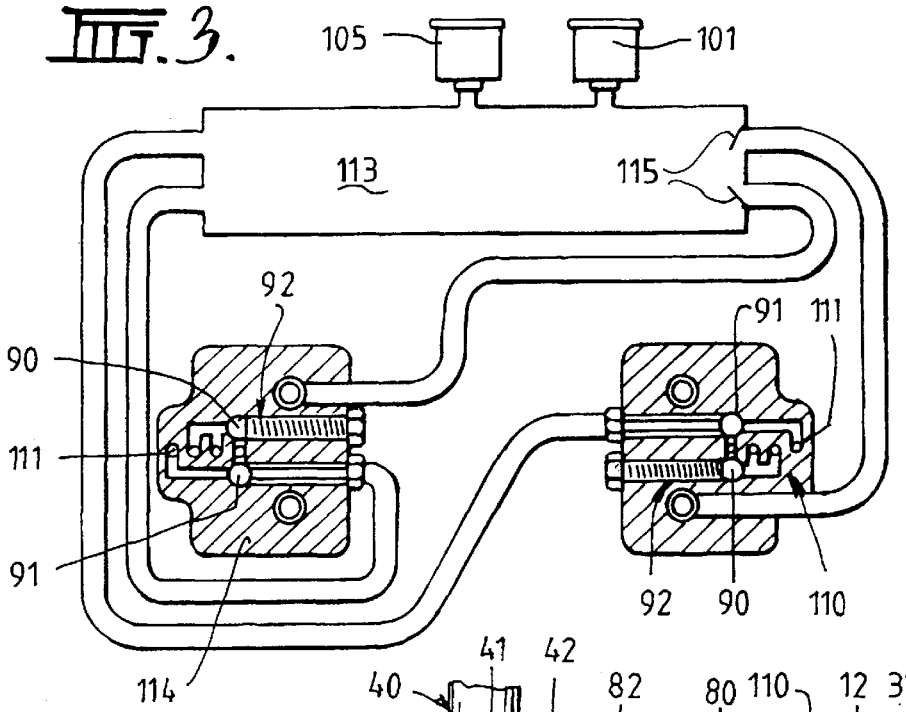
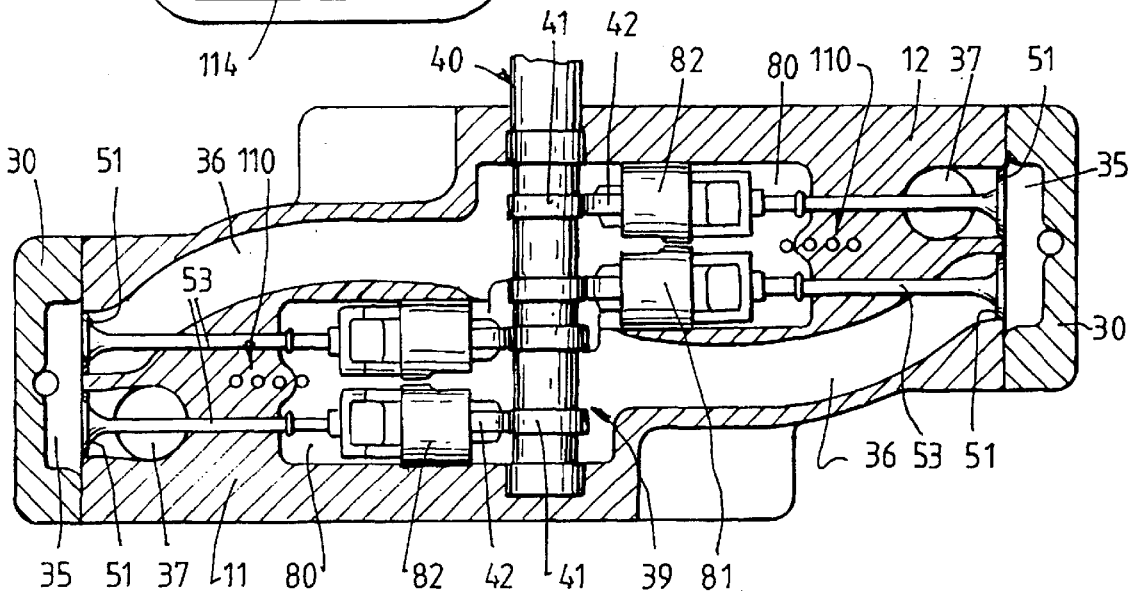
FIG. 2.

Fig. 9A
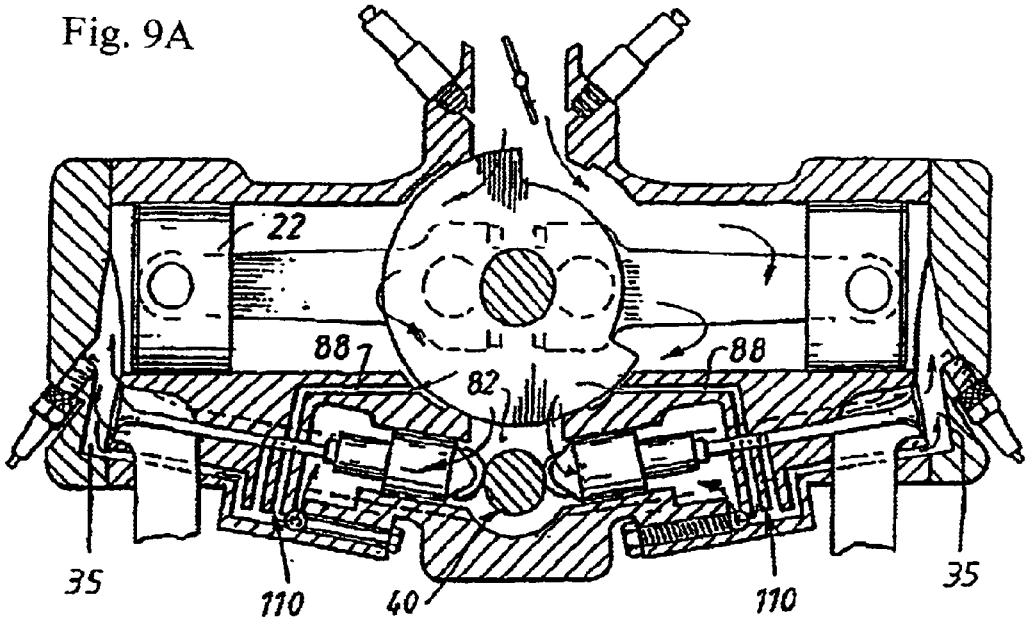
Fig. 9B
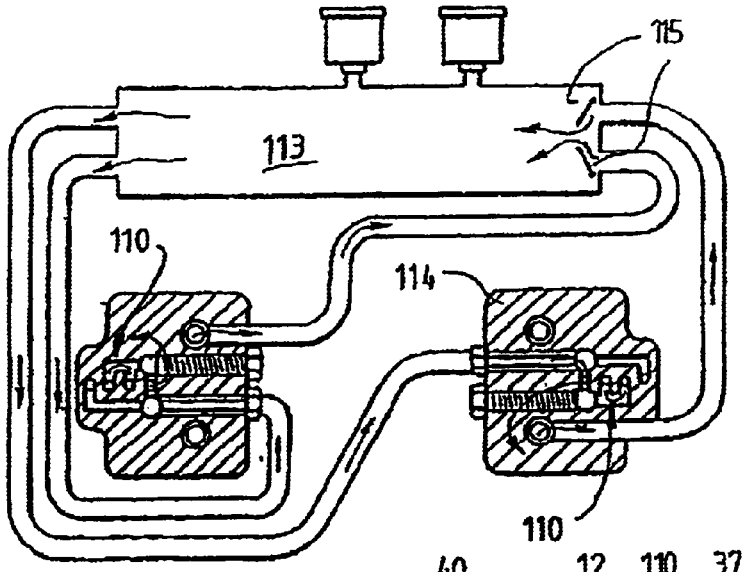
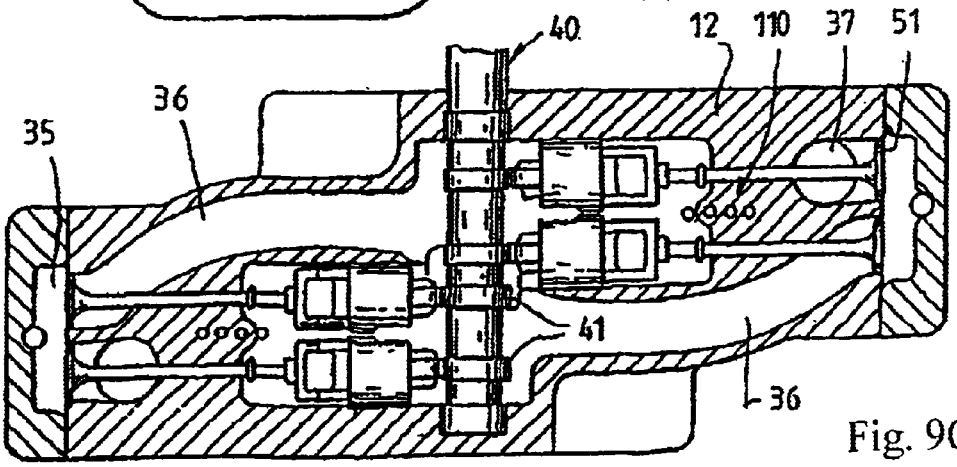
Fig. 9C

Fig. 10A
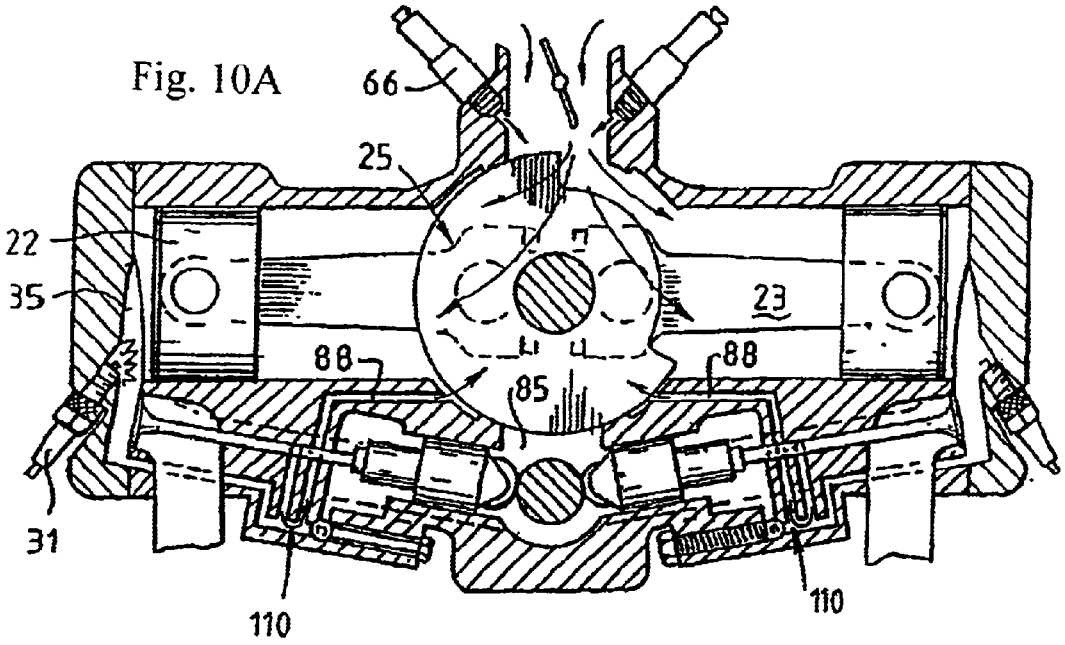
Fig. 10B
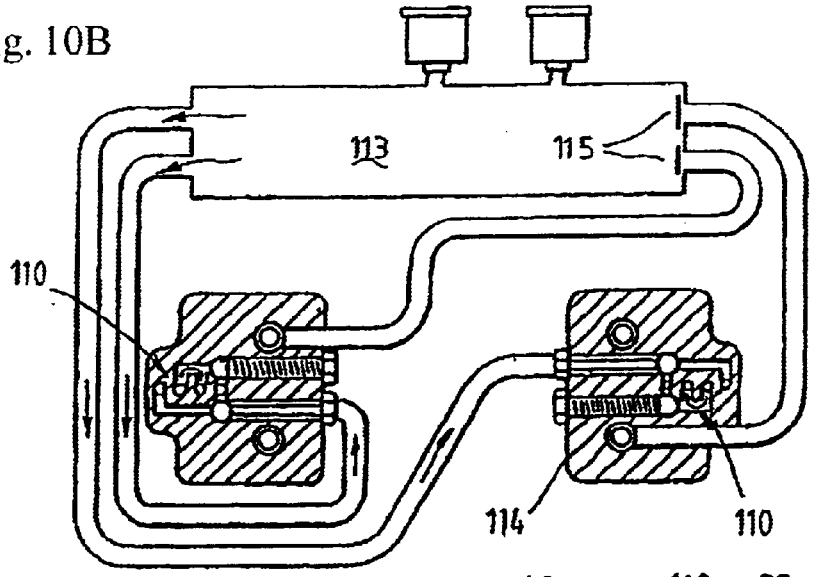
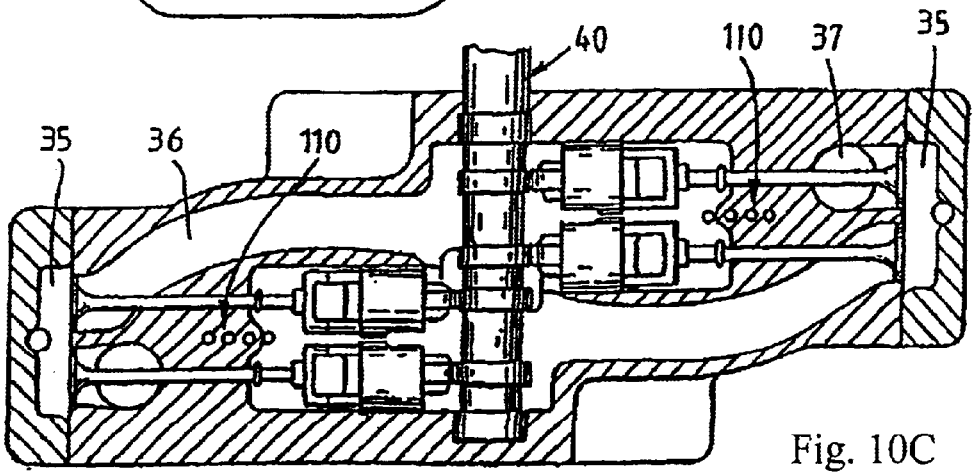
Fig. 10C

Fig. 11A
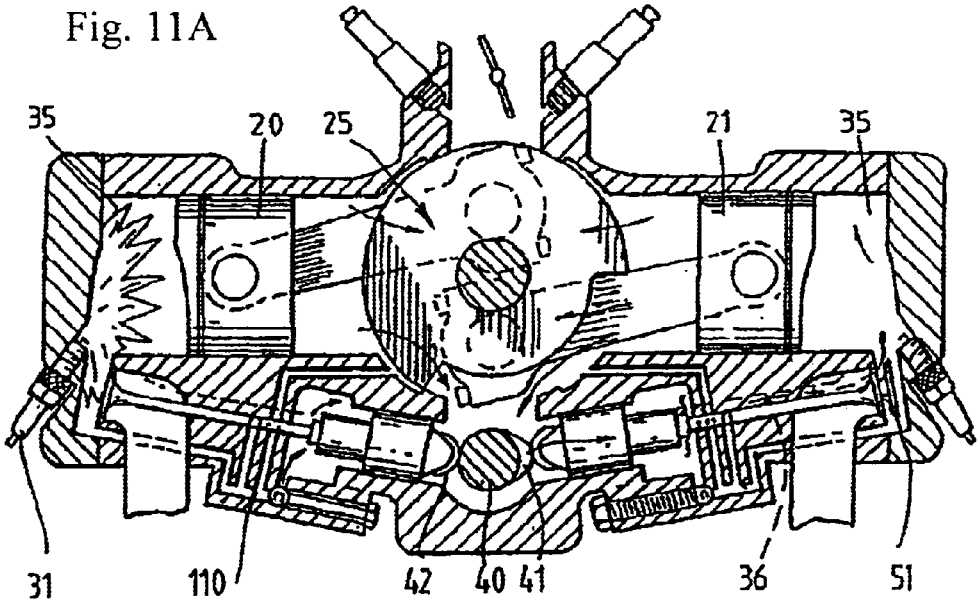
Fig. 11B
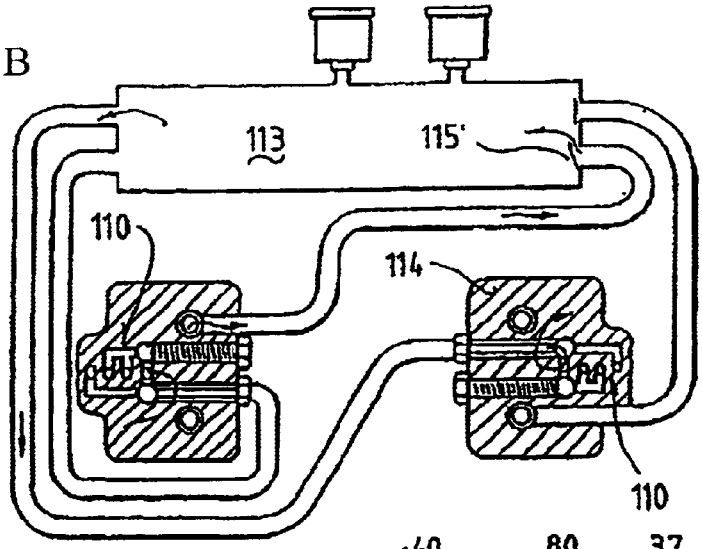
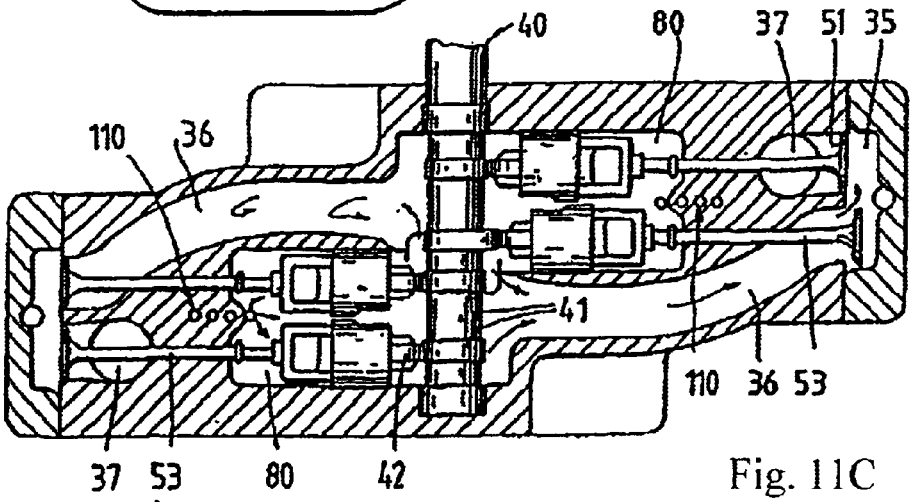
Fig. 11C

Fig. 12A
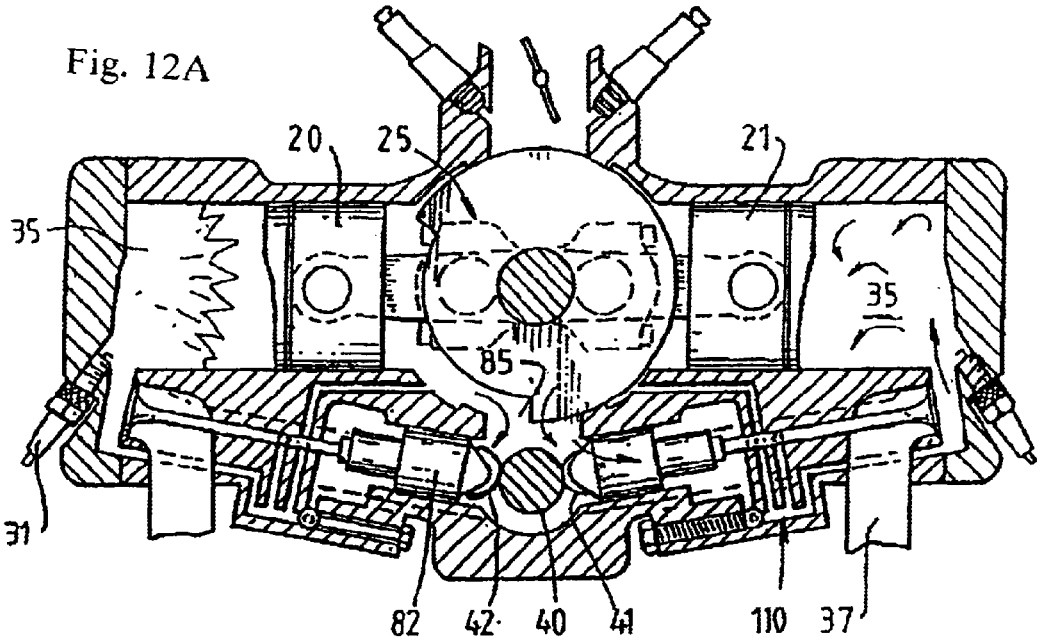
Fig. 12B
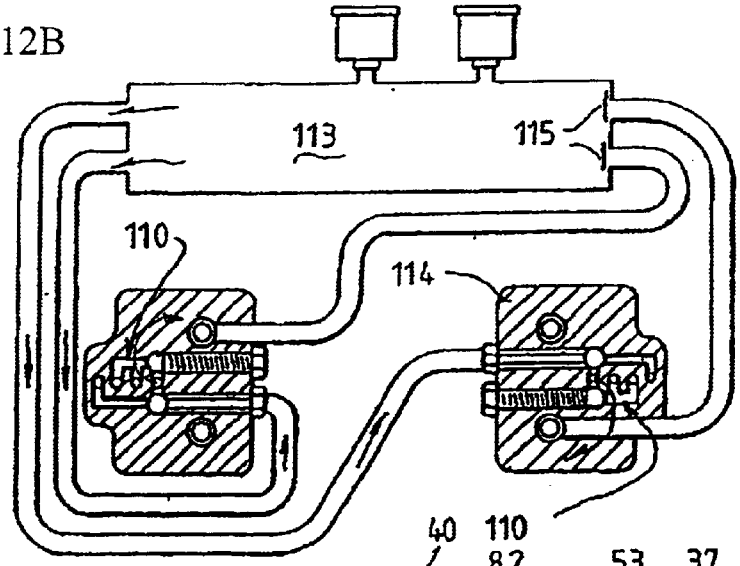
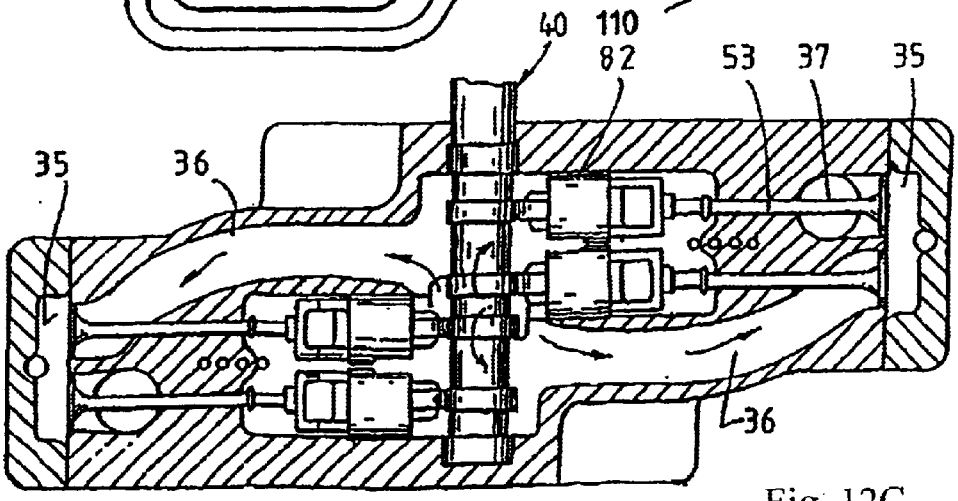
Fig. 12C

Fig. 13A
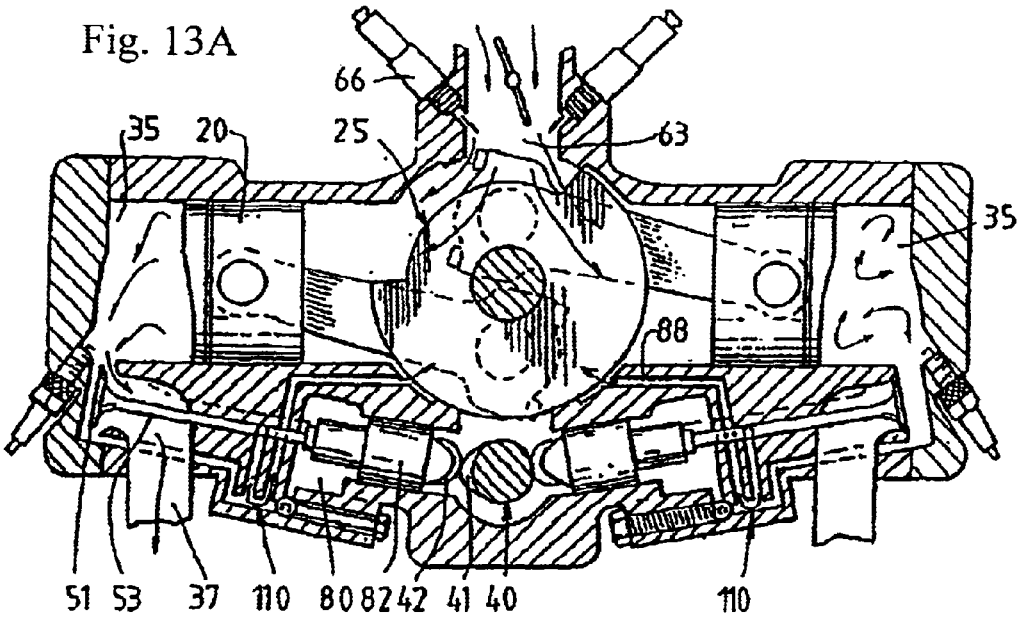
Fig. 13B
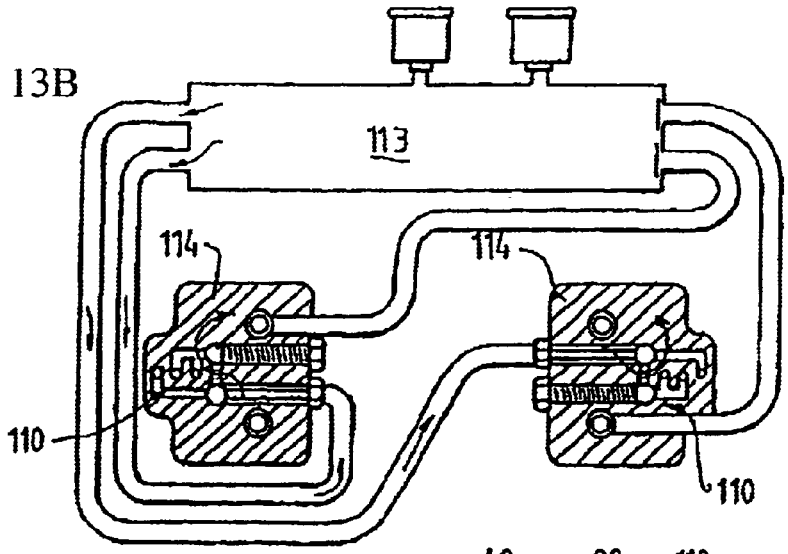
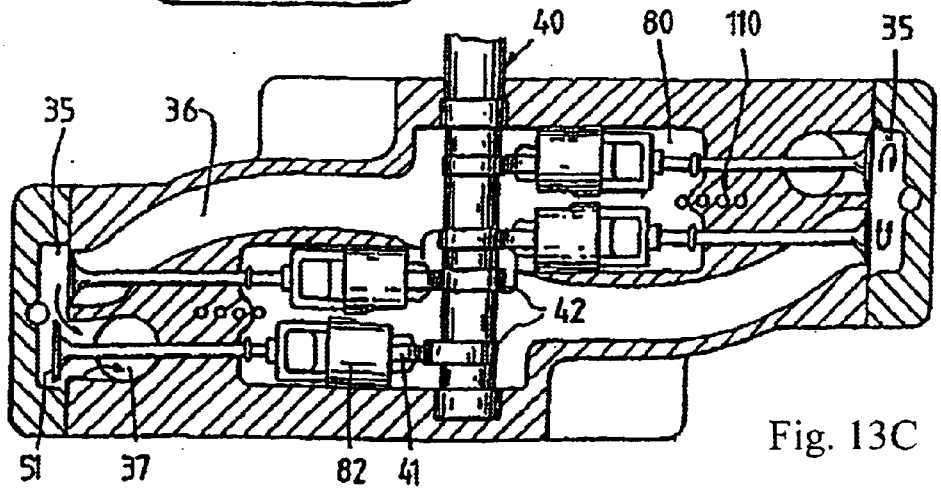
Fig. 13C

Fig. 14A
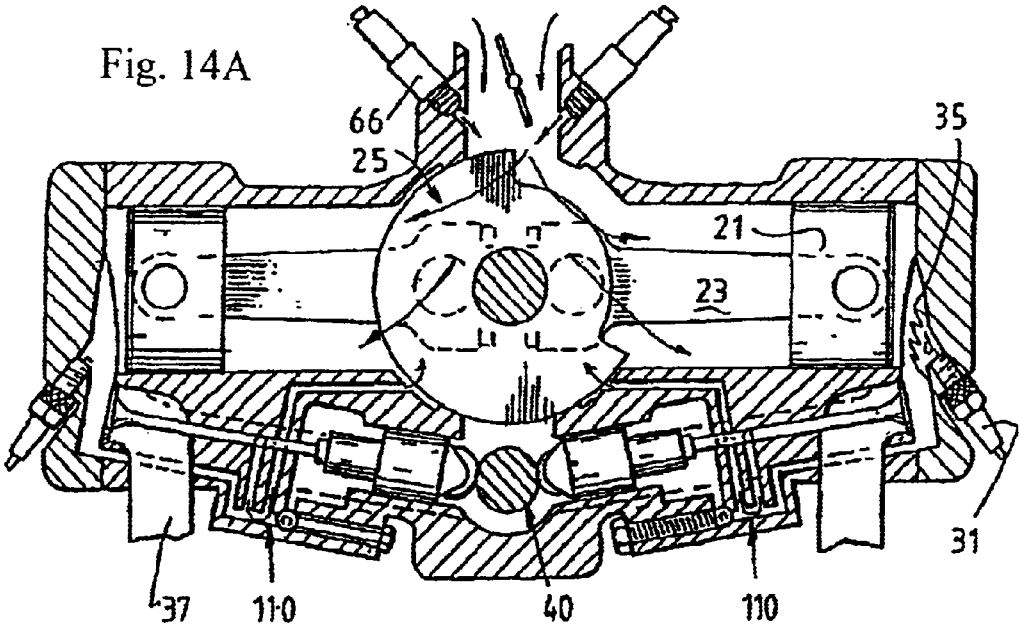
Fig. 14B
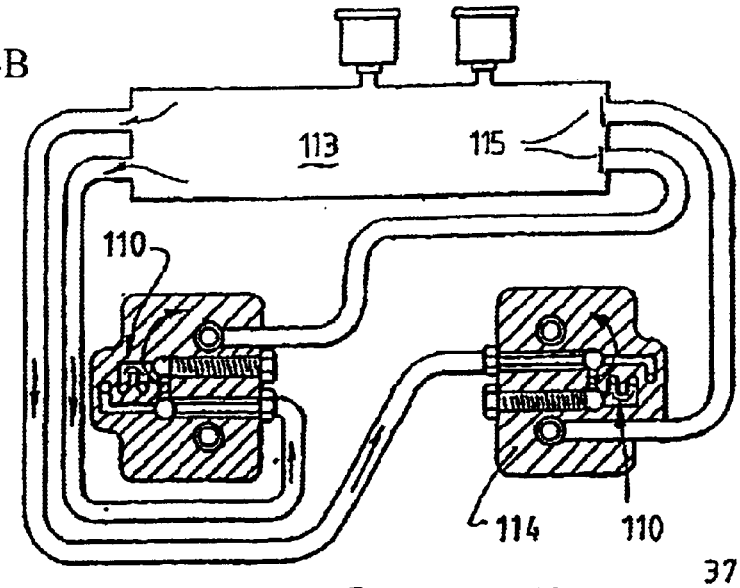
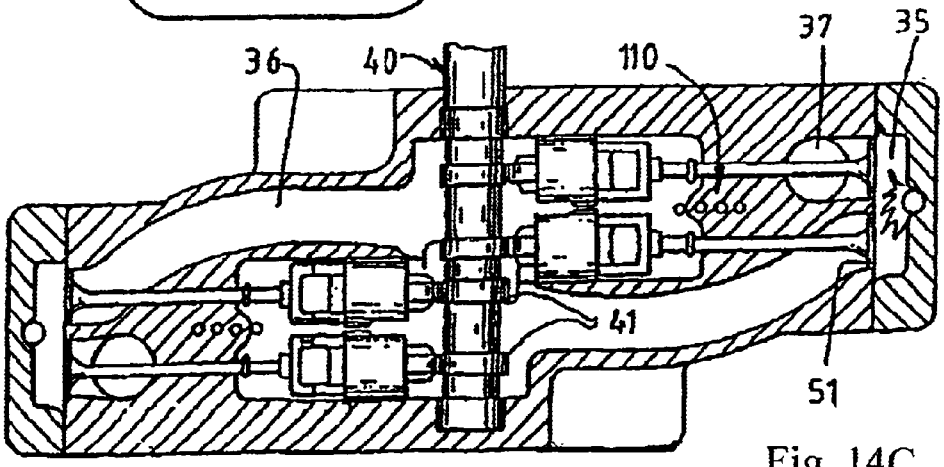
Fig. 14C

Fig. 15A
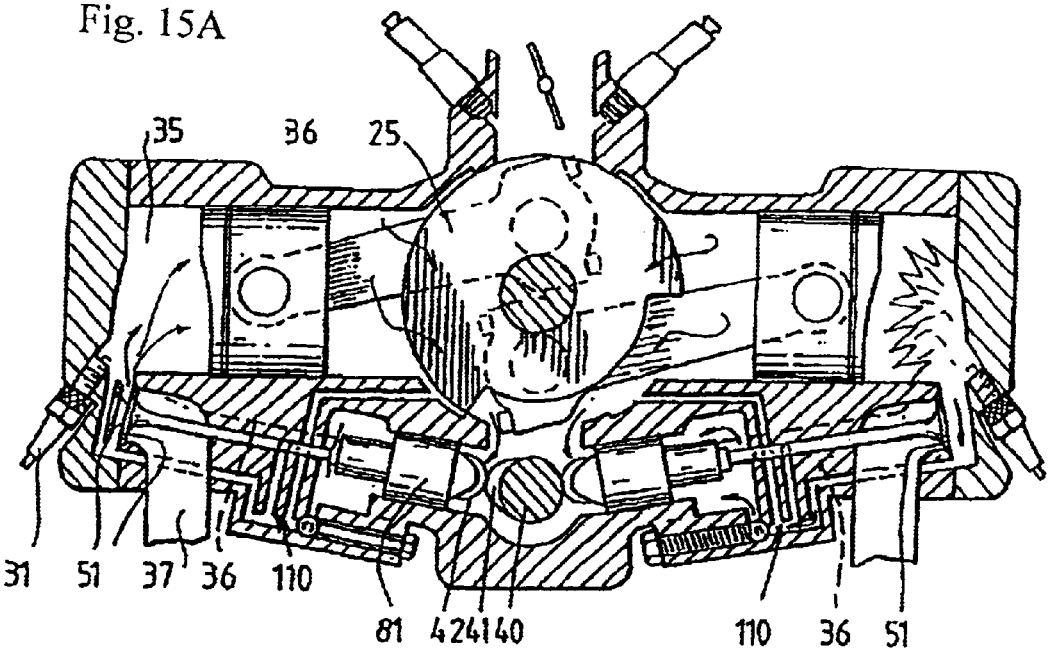
Fig. 15B
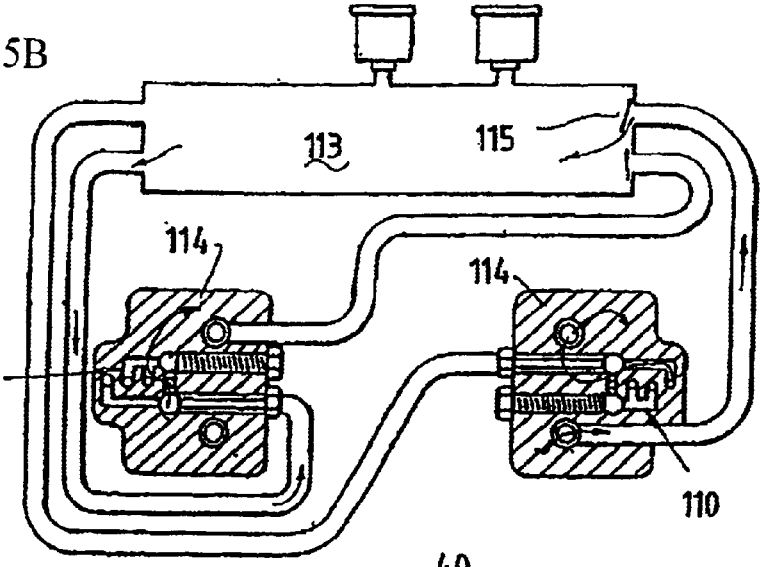
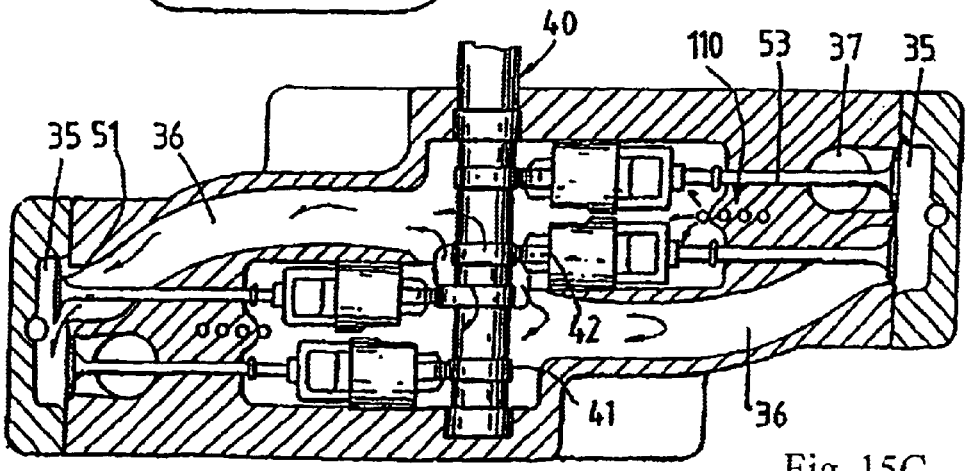
Fig. 15C

Fig. 16A
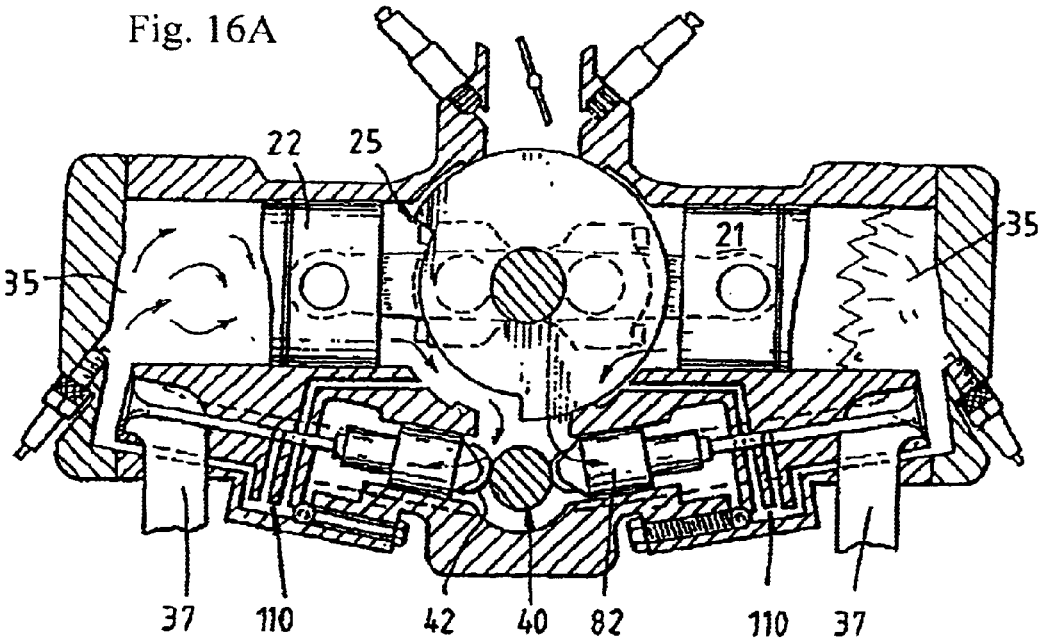
Fig. 16B
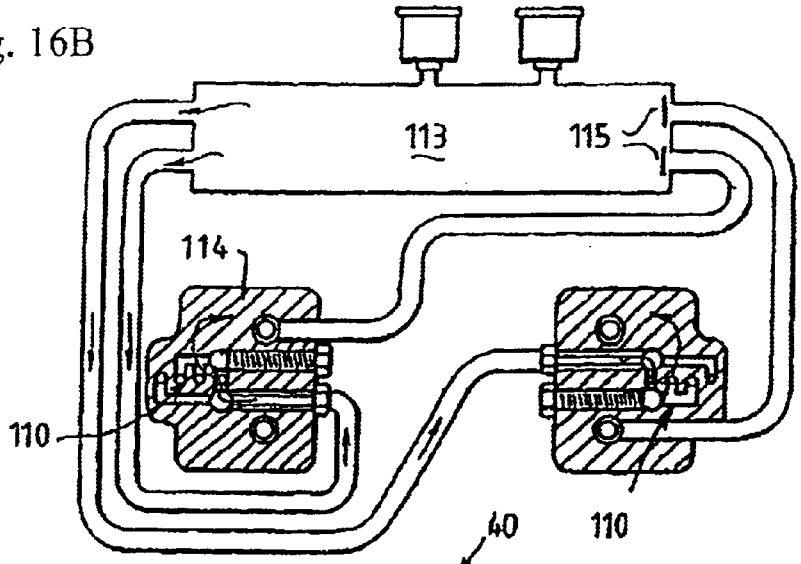
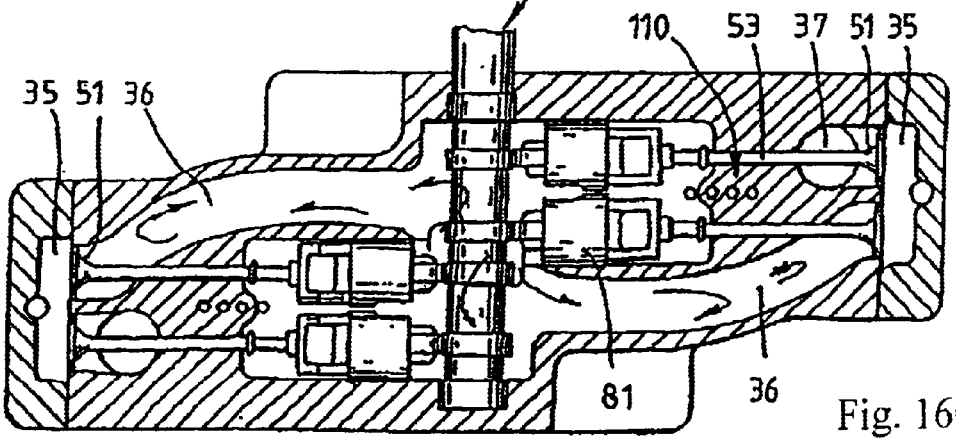
Fig. 16C

Fig. 17A
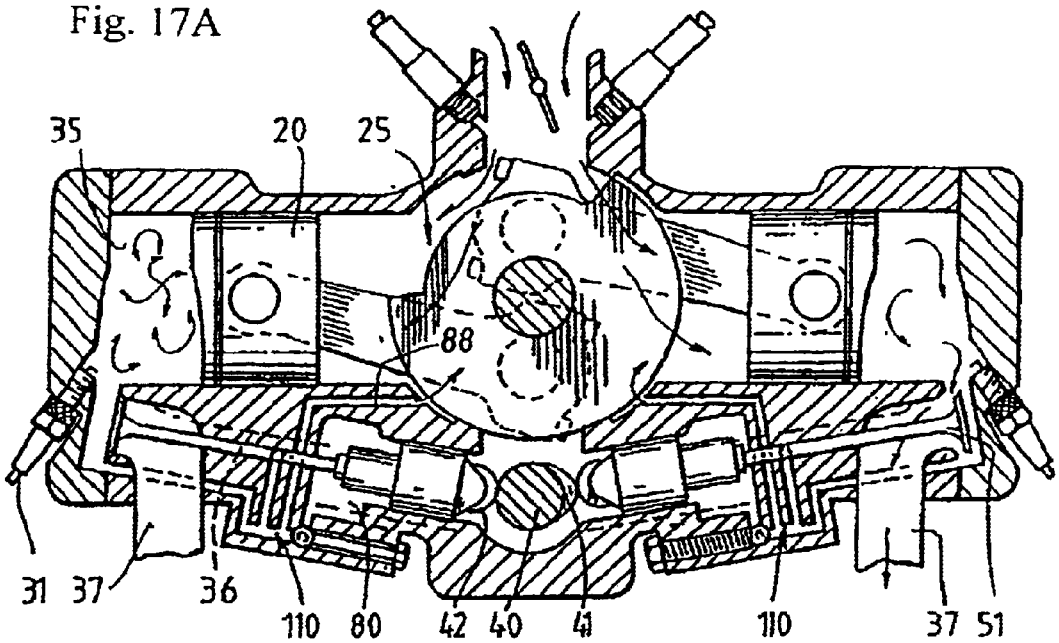
Fig. 17B
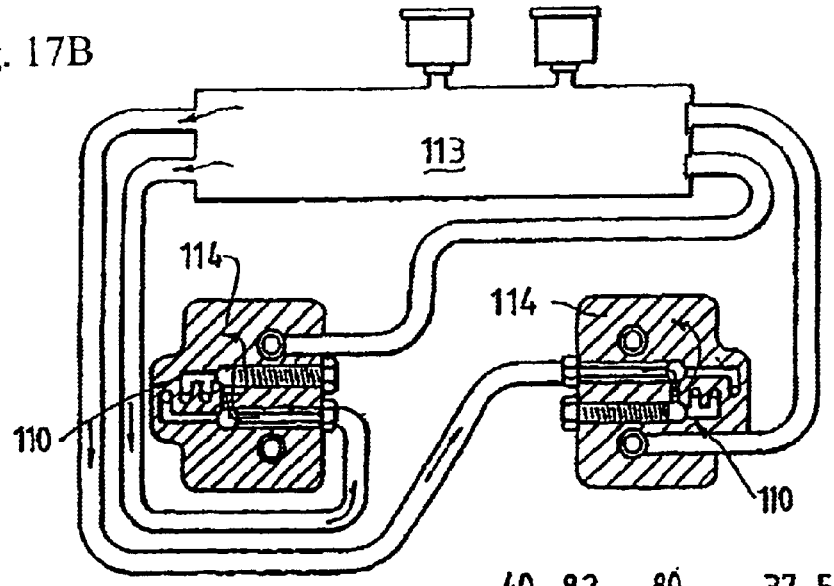
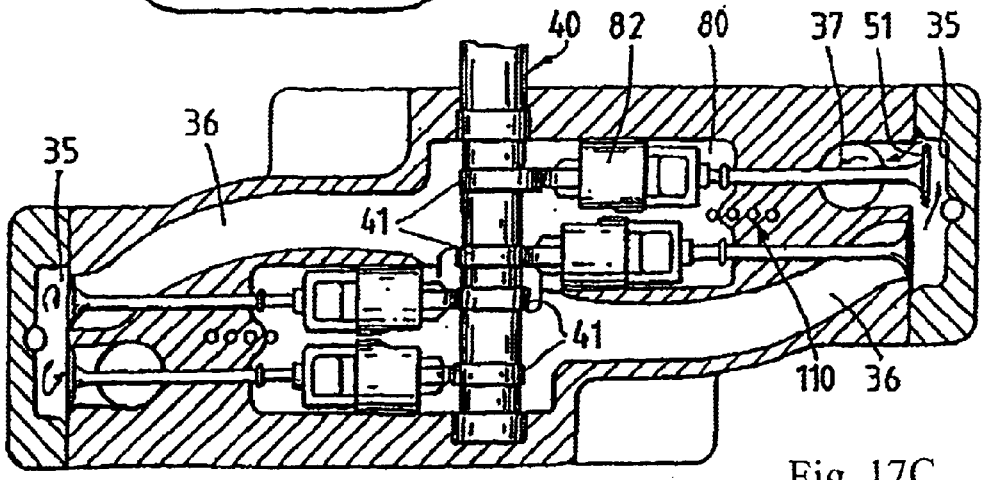
Fig. 17C

INTERNAL COMBUSTION ENGINE WITH VALVE CONTROL

INTRODUCTION

This invention relates to internal combustion engines and particularly the valve control of internal combustion engines that run on a four stroke cycle.

DISCUSSION OF THE PRIOR ART

The majority of internal combustion engines used in motor cars, trucks and motorcycles operate on a four stroke cycle. The four stroke cycle internal combustion engine has been in use for the bulk of the $20^{th}$ century. Over the years engine designers have constantly strived to improve the efficiency of such engines. In modern times these improvements in efficiency have dictated a need to also consider the environmental effects of the engine namely the production of pollutants including noxious gases that escape through the exhaust. Compromises have been reached in which the overall efficiency of the engine has been reduced by the need to introduce power absorbing equipment to purify the exhaust gases such as catalytic converters. Environmental issues have also dictated controls on fuels, consequently the addition of lead as an anti-knocking agent in high compression internal combustion engines has been phased out with the introduction of lead-free petrol resulting in further compromises in engine design.

Four stroke engines usually include at least one inlet and one exhaust valve per cylinder. In some small sophisticated engines pluralities of exhaust and inlet valves may be provided per cylinder. The valves are usually driven to an open position by the lobes of a camshaft. This drive can either be direct or indirect. The valves usually return to the closed position by the use of metal coil springs that simply urge the valve once open, back to the closed position. The size of spring force of the coil spring is designed to accommodate the engine when the largest demand is placed on the springs which is usually when the engine is running at the highest revolutions per minute (RPM). Thus, the valve springs have to be of sufficient size, weight and spring ratio to operate efficiently at the highest RPM. This means that at lower RPM the valve springs are too strong and thus unnecessary work is done against the springs causing a dramatic reduction in the engine efficiency in its normal operation range. Valve springs also have to be compressed during the starting procedure thus increasing the power required to tun over an engine to start it requiring large lead acid batteries and charging systems.

It is these considerations and the many problems discussed above that have brought about the present invention.

SUMMARY OF THE INVENTION

According to the present invention there is provided an internal combustion engine comprising at least one rotating, oscillating or reciprocating piston in a cylinder, each piston defining with the cylinder a combustion chamber, each combustion chamber having at least one inlet valve and one exhaust valve, and means to periodically open the inlet and exhaust valves, characterised in that the valves are closed by a gas spring pressurised by a source of gas pressure taken from each combustion chamber and monitored so that the closing force is proportional to the RMP of the engine.

DESCRIPTION OF THE DRAWINGS

Embodiments of the present invention will now be described by way of example only and with reference to the accompanying drawings in which:

FIG. 2 is a schematic underside view of the engine shown in FIG. 1;

FIG. 3 is a schematic illustration of the gas valve control mechanism,

FIGS. 9 to 17 comprise views of FIGS. 1 to 3 illustrating the whole four stroke cycle of the engine.

DESCRIPTION OF THE PREFERRED EMBODIMENTS

Figure 8:
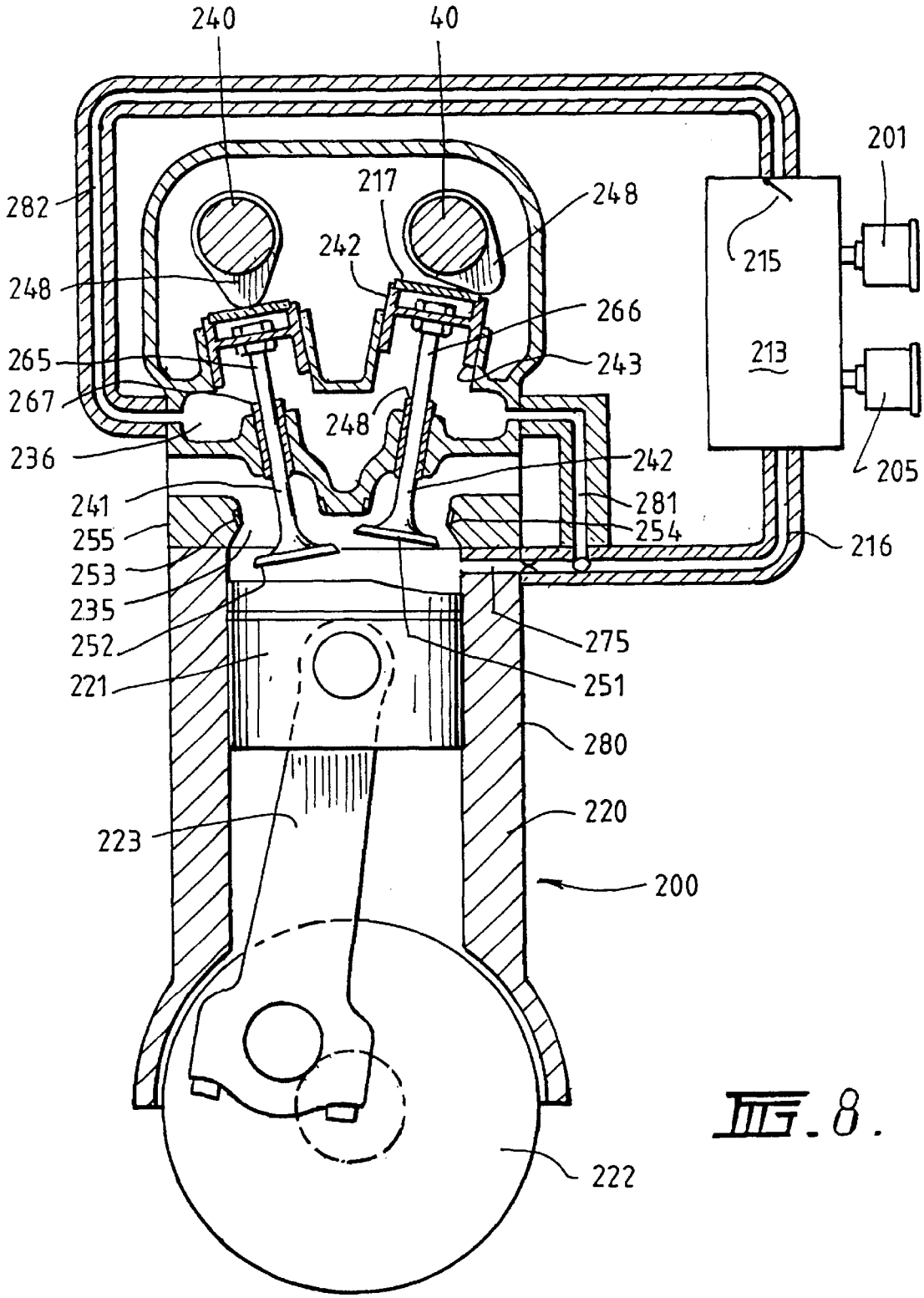
FIG. 8 is a cross sectional view of a conventional in line engine utilising a gas valve assembly in accordance with a second embodiment.

The engine shown in FIGS. 1 to 7 is the subject of a co-pending patent application of even date. The engine utilises a gas controlled valve spring details of which are described hereunder. FIG. 8 shows a more conventional engine using gas controlled valve springs.

Figure 1:
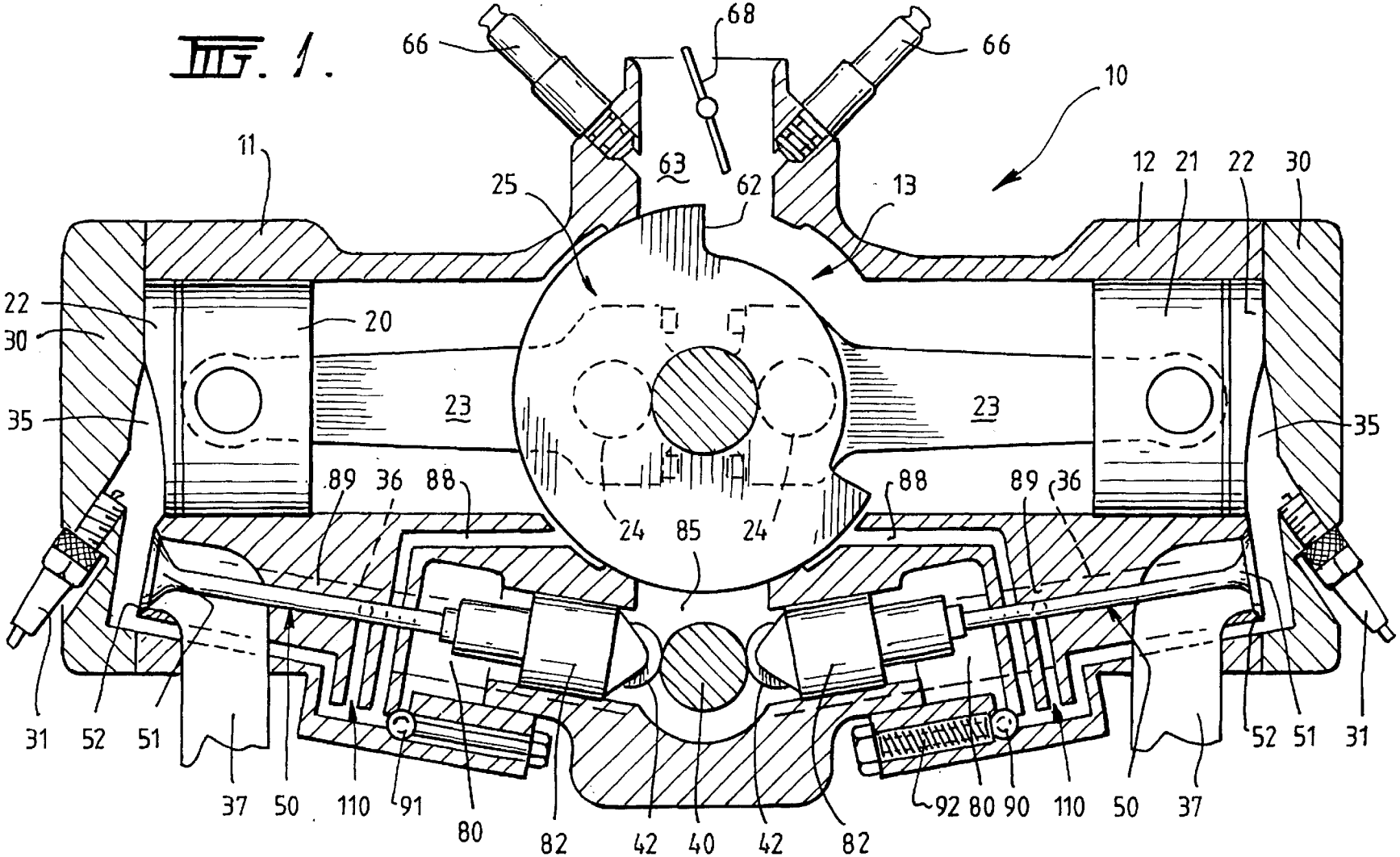
FIG. 1 is a schematic end on view of an engine in accordance with one embodiment of the invention.
Figure 4:
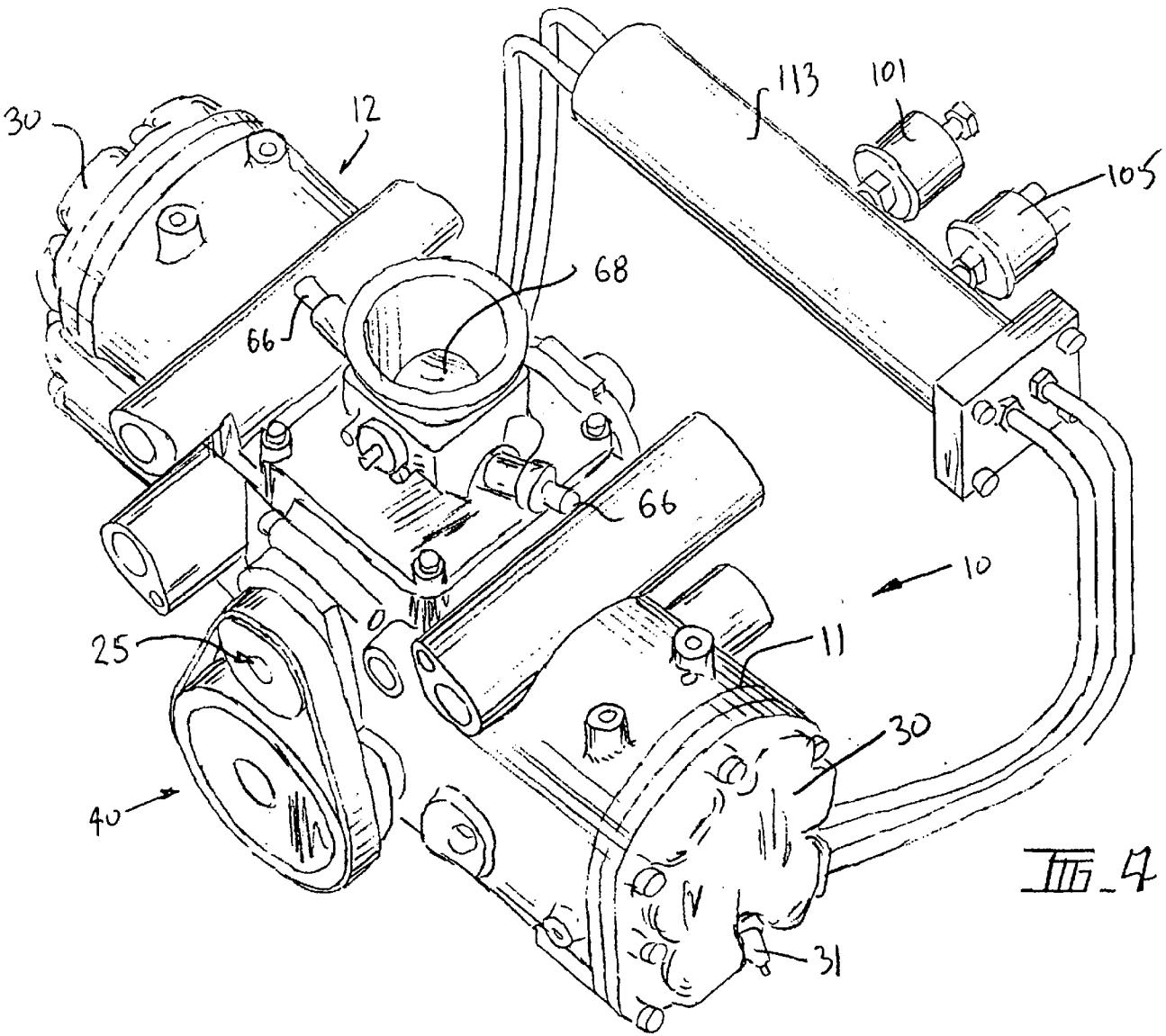
FIG. 4 is a perspective view of the engine from the top.
Figure 5:
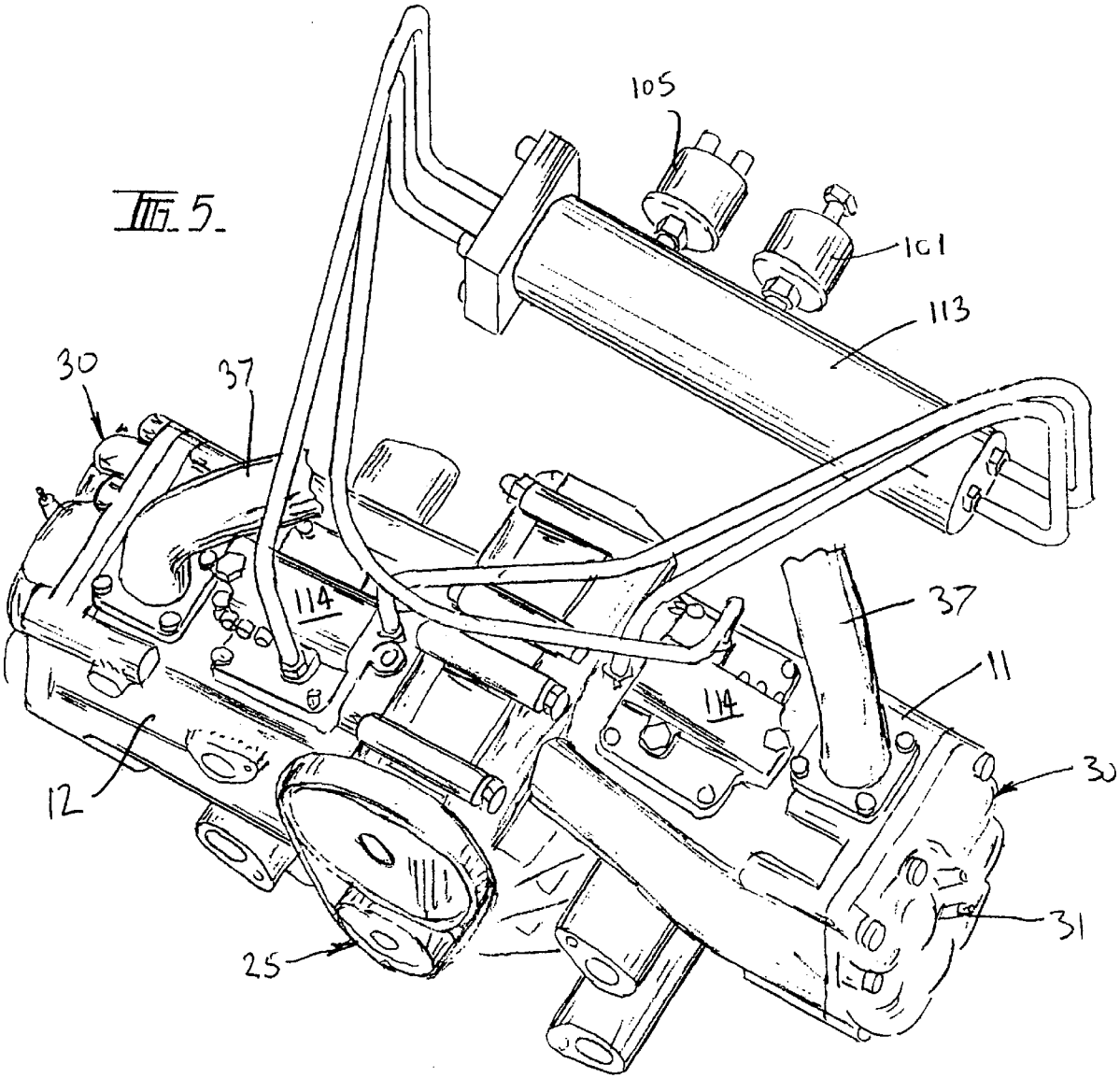
FIG. 5 is a perspective view of the engine from the bottom.
Figure 6:
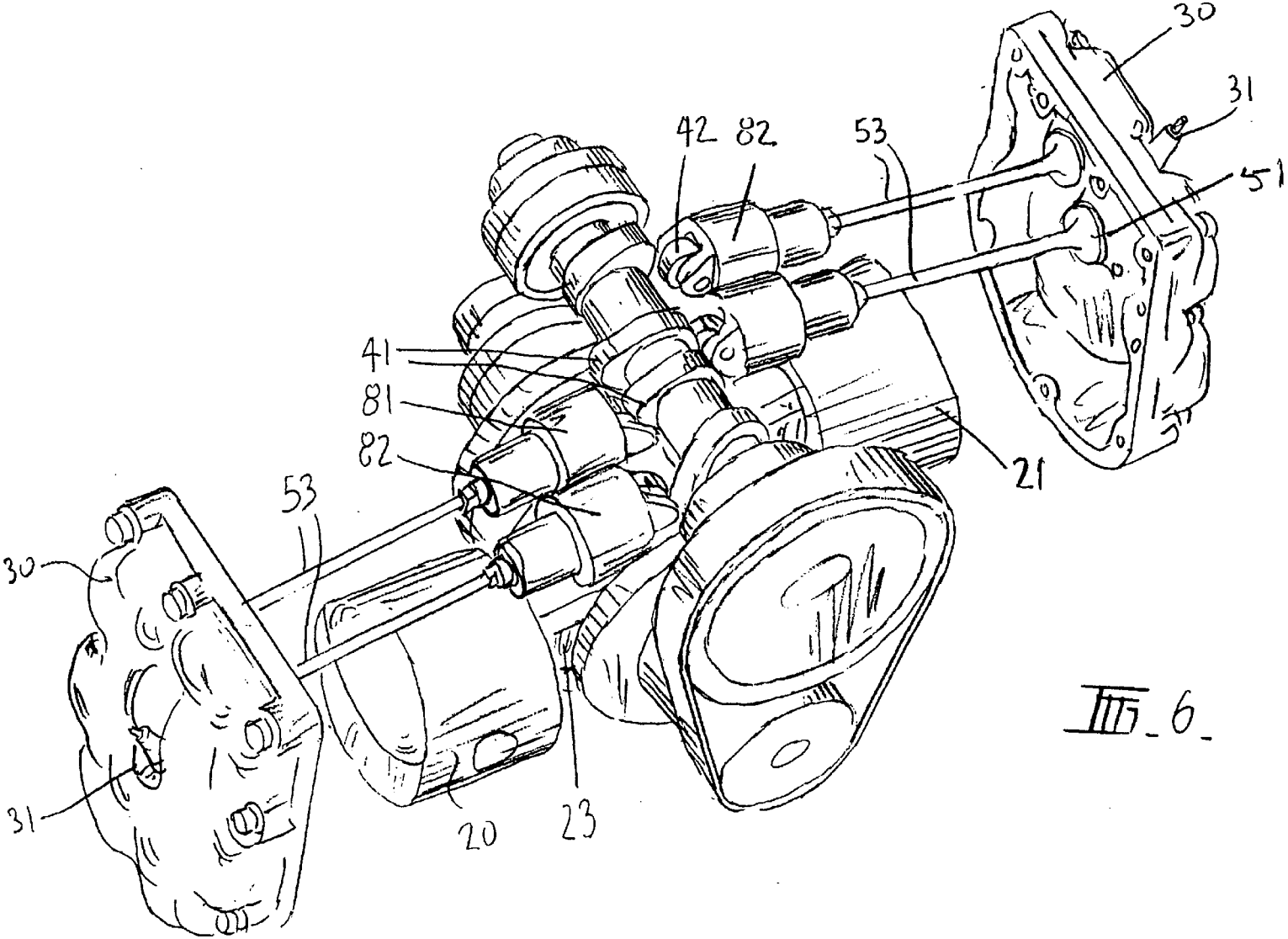
FIG. 6 is a perspective view of the engine with the crankcase and cylinder walls removed.
Figure 7:
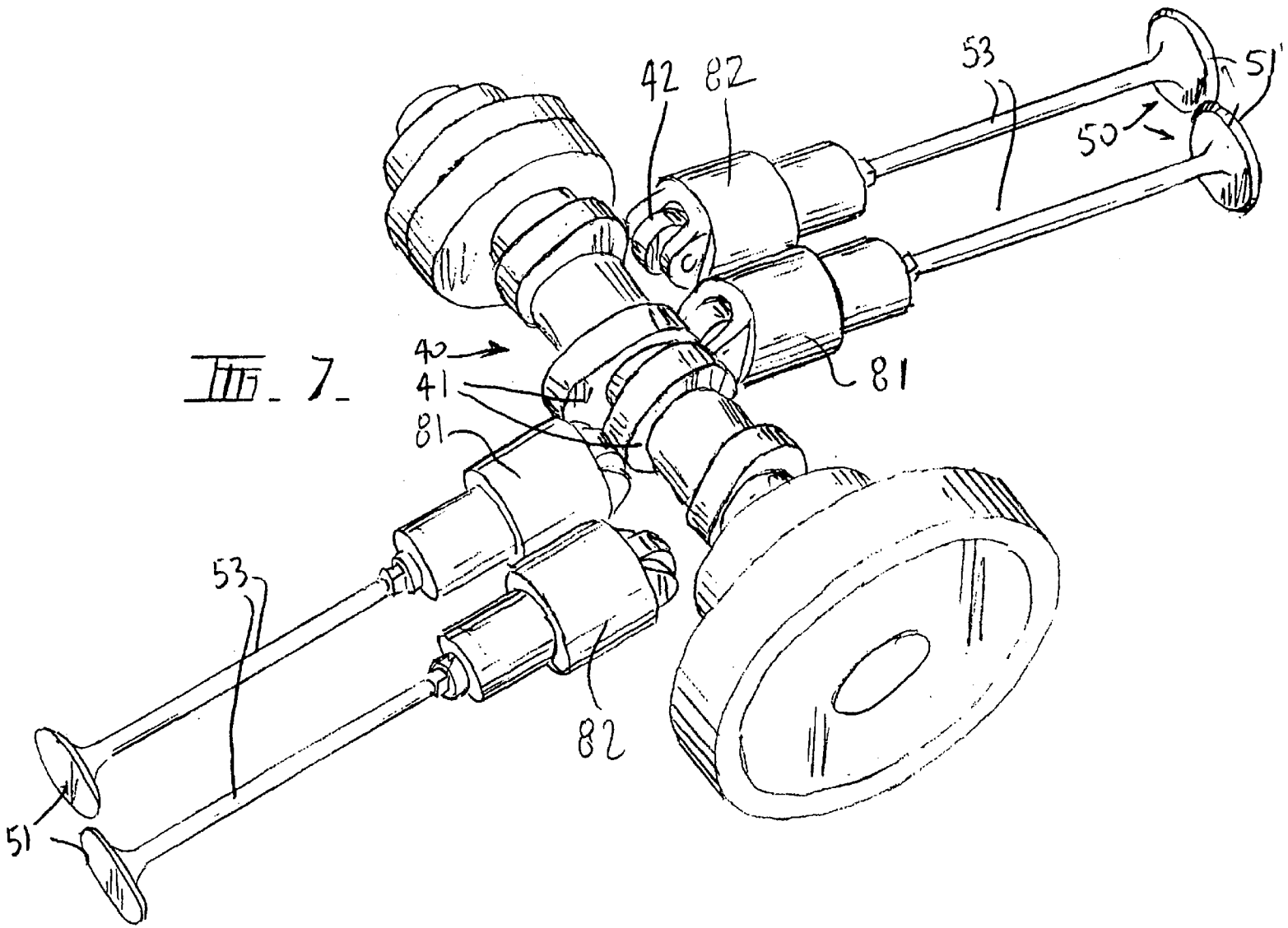
FIG. 7 is a perspective view of the camshaft and valve assemblies.

FIGS. 9–17(*a, b, c*) of the drawings illustrate the engine schematically to illustrate the method of operation using the depictions of FIGS. 1–3 respectively at a start of a cycle and at 90° intervals through the four stroke cycle of 720°. It is understood that the actual engine could be considerably different in structural detail and it is envisaged that those skilled in this art would appreciate and understand the additional detail that would be required to put the schematic illustration of the engine into practical effect.

The drawings of the preferred embodiment (FIGS. 1 to 7) illustrate an engine in the form of a horizontally opposed flat twin configuration. The engine 10 comprises cylinders 11 and 12 that extend radially outwardly from a central crankcase 13. The crankcase 13 houses a crankshaft 25 that supports reciprocating pistons 20 and 21 in cylinders 11 and 12. Each piston 20 and 21 is connected to the crankshaft 25 via a con-rod 23 and big end bearings 24. The pistons/cylinders are spaced horizontally as shown in FIG. 2. The face of each cylinder 11 and 12 is closed off by a cylinder head 30 that supports spark plug 31. The space between the interior of the cylinder head 30 and the piston crown 22 defines the combustion chamber 35. Inlet and exhaust valve port 36 and 37 communicate with the combustion chamber 35 along the wall of the cylinders 11 or 12 to constitute a side valve arrangement. Each valve port supports a valve 50 having a head 51 and stem 53. The valve head 51 seals against a valve seat 52 defined by the mouth of the port. The valves are driven by cam followers 42 that directly contact with the lobes 41 of a camshaft 40 that is driven from the crankshaft 25 by a chain, gears or toothed belt.

The opposed cylinders' housings define the central crankcase 13 that is sealed at either end. The crankshaft 25 is mounted for axial rotation about main bearings (not shown) in the crankcase. The crankshaft 25 includes a circular sealing lobe 60 with arcuate cut-outs 61, 62 that open and close an inlet air/fuel passageway 63 via a crankcase inlet port 69 at the top of the crankcase 13 and an exit passageway 65 via a crankcase outlet port 70 at the base of the crankcase 13. The air fuel mixture is derived from suitably positioned fuel injectors 66, 67 at the inlet passage 63 controlled by a conventional throttle 68. The exit passageway 65 feeds the inlet port 36 via a camshaft chamber 39. In the engine described above, the inlet and exhaust valves are controlled through direct contact with the camshaft via cam followers but are closed by a gas drive that is controlled by gas pressure coming from the combustion chamber 35 during the combustion stroke and crankcase during the starting cycle.

The engine operates on a four stroke cycle but utilises crankcase pressure to supercharge each cylinder. The air fuel mixture is pressurised within the crankcase for subsequent transfer to the combustion chamber of each cylinder via the inlet port 36 from the camshaft chamber 39. Side positioned inlet and exhaust valves 50 control the inlet of the air/fuel mixture and exhaust of the exploded gases. These valves, instead of using conventional springs to return to the closed position use a gas drive having pressure that is proportional to the RPM of the engine.

The opening of the exhaust and inlet valves is carefully controlled through the lobes on the camshaft that act against cam followers. The closing is effected by the gas spring which is pressurised by gas pressure taken from the combustion chamber during combustion stroke as well as the crankcase in a starting sequence.

The gas valve spring for each cylinder comprises a valve pressure chamber 80 that slidingly supports valve return pistons 81 and 82 that are attached respectively to the ends of the valve stems 53 of the inlet and exhaust valves 50. As shown in FIG. 2 the valve stems 53 enter the housing 80 in a spaced parallel array and the return pistons 81, 82 form part of the cam followers 42 that are in turn driven open by the lobes 41 of the camshaft 40. Each valve stem 53 extends out of the valve pressure chamber 80 to join the head 51 of the valve which communicates with the combustion chamber 35 through the side mounted inlet and exhaust ports 36 and 37 described above. In one embodiment the valve pressure chamber 80 is pressurised at start up by a source of pressure that comes from the crankcase 13 via a first gallery 88. In start up, one way control ball valve 90 is controlled by a coil spring 92, or reed valve (not shown). Once the engine has started this valve stays closed.

The primary source of gas pressure for the valve pressure chamber 80 comes from a second gallery 89 communicating from the combustion chamber 35 through a valve pressure control assembly 114 to the valve pressure chamber 80. A two-way control ball valve 91 is floating between two sealing seats with combustion pressure on one side and valve pressure on the opposite side. The volume of gas allowed to enter the valve pressure chamber 80 is controlled by a jet 111. Reservoir 113 increases valve pressure volume. This extra volume dampens pressure input pulses and allows for missed firing strokes. The reservoir 113 receives gas from the valve pressure chambers 80. The entries are controlled one way by reed valves 115. The valve pressure chambers 80 are balanced by returning gas from the reservoir 113 through the two-way valves 91. The reservoir 113 can also have a pressure release valve 101 that is controlled by the electronic control unit (ECU) that orchestrates the timing and fuel injection of the engine. In this situation also connected to the reservoir 113 is a pressure sensor 105 that sends a signal to the ECU proportional to the gas pressure. Thus the pressure in the valve pressure chambers 80 and reservoir 113 can be controlled by the ECU.

The gas valve pressure control assemblies 114 also include a third lubricating gallery 110 that communicates between the inlet valve port and the valve stems of both valves to provide a source of cooling and lubrication for the valves by introducing unburnt air fuel mixture to the valve stems. The cross sectional area of the return pistons 81 and 82 are sufficiently great that the force caused by the gas pressure within the pressure housing forces the return pistons to slide towards the camshaft 40 and thus close the valves. In this manner, the valves are closed by gas pressure and not a metal coil spring. The return pistons 81 and 82 require a sealing of cast iron or Teflon™. The ECU can ensure that the pressure and closing force is proportional to the RPM of the engine as can a mechanical control system. Although the valve pressure chambers are pressurised by the comparatively hot exhaust gases the volume of transfer and size of the second gallery is such that the assembly does not overheat. Furthermore, in one embodiment the valve pressure chambers are surrounded by a liquid cooled jacket (not shown).

It is understood that the engine could be manufactured in suitable lightweight aluminium and although the preferred embodiment illustrates a two cylinder arrangement, it is understood that these cylinders can be arranged in banks of opposed pairs so that a 2, 4, 6, 8, 10 or 12 cylinder configurations are envisaged depending on the desired power output. It is also understood that the engine could incorporate traditional liquid cooling passageways with the conventional cooling radiator and fans.

The use of a gas spring to control the closure of the inlet and exhaust valves provides an important advantage because the pressure of the gas spring is proportional to the RPM of the engine. Thus, at all times the pressure corresponds to the demands of the engine. This is in contrast with conventional coil springs that are used to close valves. These springs are designed to provide the necessary force for high RPM, thus, at lower engine speeds the springs are far too strong, thus absorbing a considerable amount of power. Springs also have other problems caused with their mass, resulting in valve bounce and other cyclic vibrations that are detrimental to engine performance. The elegance of the gas spring is that the pressure of the system is actually supplied by the combustion pressure produced during the combustion cycle. Furthermore, the gas spring assembly enables the exhaust valve to be opened later due to pressure bleed being required by pressure chambers as engine RPM increases, relieving combustion pressure towards bottom dead centre on the combustion stroke during acceleration. This gives a longer push available on the piston crown. When the engine decelerates, with a closed throttle valve, the engine naturally reduces combustion pressure. Pressure is not available to increase valve spring but is not required and the bleed of pressure from the valve pressure chambers can be reduced via an electronic control valve, controlled by an ECU in conjunction with the fuel injection and ignition systems or its own internal natural bleeding.

However, one problem exists with using gas pressure to close the valves of the engine. At start-up there is no gas to close off the valves, which would mean it would not be possible to pressurise the cylinders. The start cycle is thus illustrated in the sheets of FIGS. 1 to 3 marked "starting cycle".

The fact that the valves are unsprung means that little power is required to spin the crankshaft and turn over the engine, thus reducing the demands on the starter motor.

After a few initial revolutions driven by the starter motor to prime the engine, the inducted air fuel mixture is compressed in the crankcase and transferred to the camshaft intake cavity through the unsprung intake valves and to the combustion chambers. The crankcase pressure is also transferred via a gallery to the valve pressure chambers through the one way valve 90 in the valve pressure control assembly 114. At this point the pressure in all engine cavities except the exhaust port has been equalised. Intake and exhaust valves now have effective valve timing. Pressure in valve pressure chamber 80 will return the exhaust valve because only ambient pressure exists under the valve head and the intake valve will return because the area of the intake valve head facing the port is less than the return piston surface area.

After valve control is obtained, combustible mixture compressed and ignition has occurred piston is driven down the cylinder and the combustion pressure is fed to the valve chambers via the gallery through the two way valve 91 (reed or ball) for the first time. This raises the pressure in the valve pressure chamber to a level capable of valve control for normal operation and closed one way valves 90 stop escape of pressure to crankcase. At this stage engine assumes the normal operation cycle.

Another option to close the valves for start-up is to couple a small air priming pump to the starter motor that supplies air pressure to the valve chambers to close the valves and allow the engine to start.

FIG. 8 illustrates a typical in line four or six cylinder engine 200 with twin overhead camshafts 240 driving an inlet 241 and exhaust 242 valve per cylinder. Each cylinder 280 includes a piston 221 driven by a crankshaft 222 via a conned 223. The valve heads 251, 252 are of conventional design seating on valve seats 253, 254 in the cylinder head 255. The valves 241, 242 have valve stems 265, 266 that slide axially in valve guides 267, 268. The end of each stem opposite the head is attached to a valve piston 242 that is arranged to be a sliding fit within a cylindrical bore 243 found in a valve pressure chamber 236. The valve piston 242 has a head 217 that is engaged by the lobe 248 of the camshaft 240 to drive the valve piston down 242 and open the valve 241, 242. The valve pressure chamber 236 is pressurised with exhaust gases that are taken from the combustion chamber 235 via a bleed passageway 275 located in the cylinder wall 280.

As can be seen from FIG. 8, the valve pressure chamber 236 has an infeed 281 that is fed from the bleed passageway 275 in the cylinder wall. The infeed 281 is on one side of the cylinder head whilst on the opposite side there is an outlet feed passageway 282 from the pressure chamber 236 that is inturn fed to a reservoir 213 that includes a one way valve 215, a pressure sensor 201 and a pressure bleed valve 205. The pressure reservoir 213 has an outlet 216 that inturn communicates with the infeed 281. In this way there is a closed circuit constantly pressurising the valve pressure chamber 236. The pressure and thus force that closes the valves is directly dependent to the RPM of the engine and the pressure is controlled during running and start up in the same manner as described with reference to the first embodiment.

The claims defining the invention are as follows:

1. An internal combustion engine comprising at least one rotating, oscillating or reciprocating piston in a cylinder, each piston defining with the cylinder a combustion chamber, each combustion chamber having at least one inlet valve and one exhaust valve, and means to periodically open the inlet and exhaust valves, wherein the valves are closed by a gas which is pressurized by a source of gas pressure taken from each combustion chamber and which is monitored and controlled by a monitor means so that the closing force is proportional to the RPM of the engine.

2. The internal combustion engine according to claim 1 wherein the engine comprises a plurality of pistons reciprocating in cylinders joined by a crankcase.

3. The internal combustion engine according to claim 1 wherein, at start up, the gas spring is pressurized by a source of pressure taken from the crankcase or from a priming pump that is attached to or operates in conjunction with a starter motor.

4. The internal combustion engine according to claim 1, wherein the means to periodically open the inlet and exhaust valves comprises a camshaft.

5. The internal combustion engine according to claim 1, wherein the gas spring comprises a valve return piston adapted to engage each valve, the valve return piston being axially displaceable in a valve pressure chamber, one side of the valve return piston being pressurized by gas taken from the combustion chamber to force the valve closed.

6. The internal combustion engine according to claim 5, wherein the opposite side of the valve return piston is driven by the crankshaft to open the valve.

7. The internal combustion engine according to claim 5, wherein each cylinder has a valve pressure chamber that houses valve return pistons that drive the inlet and exhaust valves respectively.

8. The internal combustion engine according to claim 7, wherein the valve pressure chambers are in fluid communication with a reservoir with the communication being controlled by valves.

9. The internal combustion engine according to claim 1, wherein a pair of pistons reciprocate in cylinders joined by a crankcase, each piston being driven by a crankshaft housed in the crankcase, the crankcase including an inlet port for entry of an air fuel mixture and an outlet port for transfer of compressed air fuel mixture, the inlet and exhaust valves being positioned in inlet and exhaust valve chambers communicating with the combustion chamber, the inlet valve chamber being in communication with the crankcase via the outlet port whereby the engine is adapted to run on a four stroke cycle with the underside of the piston pressurizing the air fuel mixture in the crankcase and causing transfer of the pressurized air fuel mixture to the combustion chamber via the outlet port and inlet valve chamber.

10. The internal combustion engine according to claim 9, wherein the crankshaft includes a rotary valve that opens and closes the inlet and outlet ports as the crankshaft rotates.

11. The internal combustion engine according to claim 9, wherein a camshaft is positioned to rotate within a camshaft chamber that is in fluid communication with the inlet valve chamber of each cylinder and the crankcase via the outlet port.

* * * * *